US007673696B1

(12) United States Patent
Gunn

(10) Patent No.: US 7,673,696 B1
(45) Date of Patent: Mar. 9, 2010

(54) FIRE PROTECTION ROOFTOP SPRINKLER SYSTEM

(76) Inventor: Tim Gunn, 5750 Happy Pines, Foresthill, CA (US) 95631

( * ) Notice: Subject to any disclaimer, the term of this patent is extended or adjusted under 35 U.S.C. 154(b) by 41 days.

(21) Appl. No.: 12/072,830

(22) Filed: Feb. 27, 2008

(51) Int. Cl.
*A62C 3/00* (2006.01)
*A62C 8/00* (2006.01)
*A62C 25/00* (2006.01)
*B05B 15/06* (2006.01)

(52) U.S. Cl. ..... 169/46; 169/16; 169/48; 169/51; 169/54; 239/208; 239/280.5

(58) Field of Classification Search ..... 169/13, 169/16, 45, 46, 48, 51, 54; 239/208, 209, 239/280, 550, 565, 280.5
See application file for complete search history.

(56) References Cited

U.S. PATENT DOCUMENTS 3,576,212 A 4/1971 Siler
4,055,304 A 10/1977 Munson
4,091,876 A 5/1978 Valdatta
4,330,040 A * 5/1982 Ence et al. ..... 169/13
4,824,020 A 4/1989 Harward
6,360,968 B1 * 3/2002 Orrange et al. ..... 239/273
6,824,073 B1 * 11/2004 Haney ..... 239/208
2008/0289830 A1 * 11/2008 Olson ..... 169/16

* cited by examiner

*Primary Examiner*—Len Tran
*Assistant Examiner*—Ryan Reis
(74) *Attorney, Agent, or Firm*—Heisler & Associates

(57) ABSTRACT

A sprinkler system that can be quickly deployed for preventing brush and forest fires from engulfing a home. The system includes at least one assembly with a sprinkler on a base. The base straddles the roof ridge. The base adjusts to different roof pitches. The assemblies include hose interfaces to allow connection of a hose routed from a water supply. A fire retardant solution or fire fighting foam can be added downstream of the supply. The sprinklers wet the rooftop and a portion of the surrounding grounds. An optional pump and independent power supply can be added to route water from an available reservoir.

12 Claims, 3 Drawing Sheets

FIRE PROTECTION ROOFTOP SPRINKLER SYSTEM

FIELD OF THE INVENTION

This invention relates to protection of buildings from wildfires with water sprinklers on roofs. Historically forest and brush fires have burned thousands of acres and destroyed many homes throughout the United States and the world, and this will continue to occur in the future. Many homes and buildings are burned from direct contact with flames or most often from embers that are blown ahead of the main fire and fall on roofs of homes and buildings, sometimes a long distance from the fire. The present invention is designed to wet the rooftop of a building and a portion of the surrounding grounds to help prevent ignition of the building.

BACKGROUND OF THE INVENTION

Rooftop sprinkler systems can range from expensive and permanent hard-piped systems to a homeowner simply turning a hose on a building ahead of a wildfire. The present invention can be quickly and inexpensively deployed ahead of an impending wildfire and allow the homeowner to safely evacuate.

Examples of most-closely related known, but yet different devices and systems are described in the following patent documents. U.S. Pat. No. 6,360,968 issued to Orrange on Mar. 26, 2002, taught a sprinkler system with legs resting on opposite slopes of the roof, above the ridge, instead of an assembly that straddles the roof ridge as taught by this invention. U.S. Pat. No. 4,824,020, issued to Harward on Apr. 25, 1989, described a sprinkler stand on legs, with the points of the legs being positioned in soil to arrest pivoting. U.S. Pat. No. 4,330,040, issued to Ince, et al. on May 18, 1982, described a fire preventing and cooling system with tubes having orifices permanently on rooftops for dispensing water differently than a temporary roof ridge straddling assembly, such as taught by this Applicant. U.S. Pat. No. 4,091,876, issued to Valdatta on May 30, 1978, described a fire sprinkler system for mobile homes having a loop of tubing mounted on the perimeter of their flat roofs with sprinklers pointed inwardly. U.S. Pat. No. 3,576,212, issued to Siler on Apr. 27, 1971, taught a fire-shielding device with sprinklers on stands positioned on ground surfaces and extended higher than a roof of a building for spraying water on the roof effectively.

SUMMARY OF THE INVENTION

Objects of patentable novelty and utility taught by this invention are to provide a wildfire rooftop sprinkler system which: directs spray of water and/or fire retardant or fire fighting foam on rooftops and also on limited peripheral areas for fire protection; includes sprinklers, each on a one piece A-frame assembly that straddles the roof ridge; can be deployed on a roof quickly in event of a wildfire; requires no assembly; low profile design requires no anchor weights or roof attachments; has series connectivity for multiple assemblies to be positioned wherever needed on large and multi-sectioned roofs; connects easily to a garden hose for a water supply; can be stacked for commercial distribution and for consumer storage when not in use; can be used to distribute a fire retardant solution or fire fighting foam; can be used as an effective irrigation sprinkler; is light enough to be easily carried on a ladder for positioning on a roof; can be produced inexpensively for low-cost but highly effective wildfire protection when needed; low profile design is aesthetic and may be positioned reliably on rooftops indefinitely.

This invention accomplishes these and other objectives with a wildfire rooftop sprinkler system having sprinklers on a one piece base positioned temporarily or indefinitely as needed on roofs with the base formed to straddle the roof ridge. The invention can be removed for use in common sprinkler irrigation or stored when not in use for wildfire protection. The rotating sprinklers can wet rooftops, gutters, nearby trees, shrubs, and areas for protection against flying sparks and burning particles. Backup supply of water can be provided from an available reservoir with a pump powered by a motor or a heat engine in a power system that is isolated from a potential wildfire.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and the descriptive matter in which they are illustrated preferred embodiments of the invention.

DESCRIPTION OF THE PREFERRED EMBODIMENT

Figure 1:
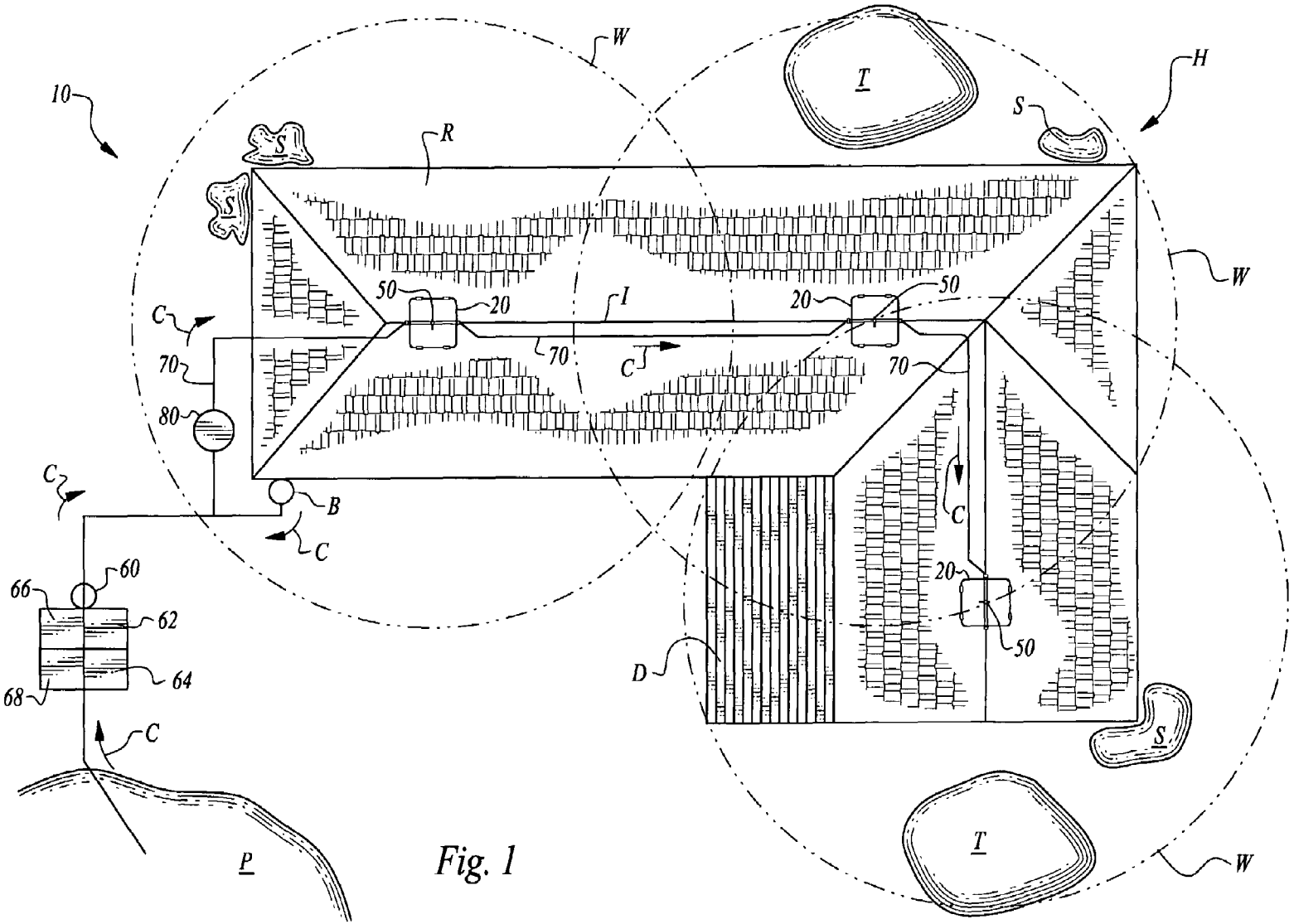
FIG. 1 is a top plan view of a structure, such as a house, with the system of this invention deployed thereon and with water delivered from the system depicted being dispersed over the structure and surrounding area close the structure.
Figure 6:
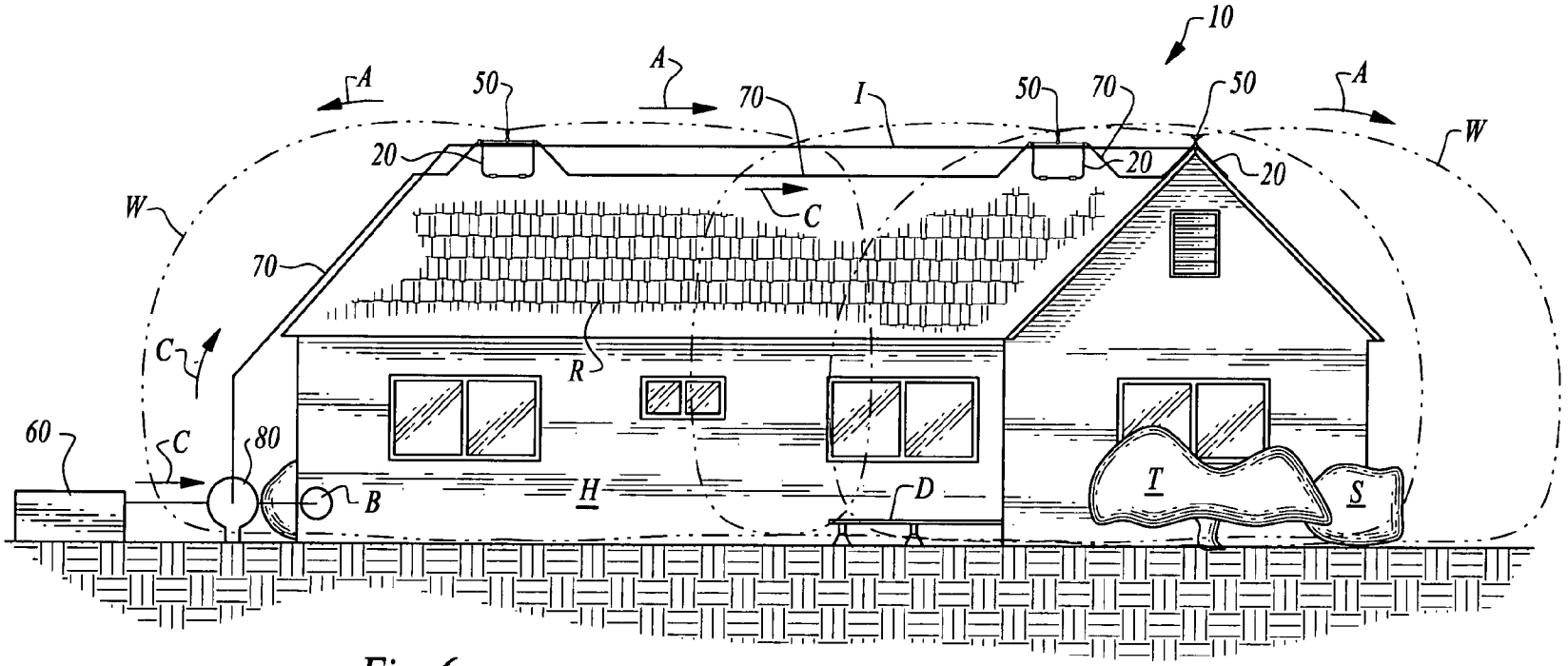
FIG. 6 is a front elevation view of the structure with the system of this invention deployed thereon and showing the system in operation distributing water over the structure.

Referring to the drawings, wherein like reference numerals represent like parts throughout the various drawing figures, reference numeral 10 is directed to a system for protecting a structure from wildfire (FIGS. 1 and 6) by placing at least one sprinkler 50 on a roof R of the structure (such as a house H) in a removable attachable fashion. The system 10 generally includes a series of separate assemblies 20 with each assembly including a base 30 and a sprinkler 50. The assemblies 20 can be coupled together serially through hoses 70 so that the system can flexibly expand to match a size of the structure to be protected. Both the house H as well as surrounding shrubs S and trees T can be protected by the distribution of water W from the system 10 (along arrow A of FIG. 6) of this invention (FIGS. 1 and 6).

In essence, and with particular reference to FIGS. 1-6, basic details of this invention are described, according to a preferred embodiment. The system 10 could include as few as one of the assemblies 20 coupled to a hose 70 for supply of water W to the assembly 20. Each assembly 20 (FIGS. 2-5) includes a base 30 for straddling a ridge I of a roof R of a house H or other structure. The base 30 is generally configured as a loop 32 coupled to a center tube 40 extending parallel with and adjacent to the ridge I of the roof R. This loop 32 extends laterally on either side of the center tube 40 so that the base 30 provides a stable platform for the assembly 20. The sprinkler 50 is mounted to the center tube 40 and extending up from the center tube 40. The center tube 40 can interface with at least one hose 70 and preferably multiple hoses 70 for serial attachment of assemblies 20 within the system 10.

In a simplest form of the invention, the hoses 70 are merely coupled to a hose bib B of the house H or other structure to supply water under pressure for the system 10. As an alternative, and to provide redundancy should water pressure be lost during a wildfire, a pump 60 can be utilized coupled to a reservoir P. To make sure the pump 60 can operate even if the power should go out during a wildfire, the pump 60 preferably is powered by batteries 62 or an engine 66. The hoses 70 can be routed through a fire retardant tank 80 before arriving at the assemblies 20. This fire retardant tank 80 can be loaded with a water borne fire retardant material that is carried through the system 10 along with the water W for distribution over the house H (along arrow A of FIG. 6).

Figure 4:
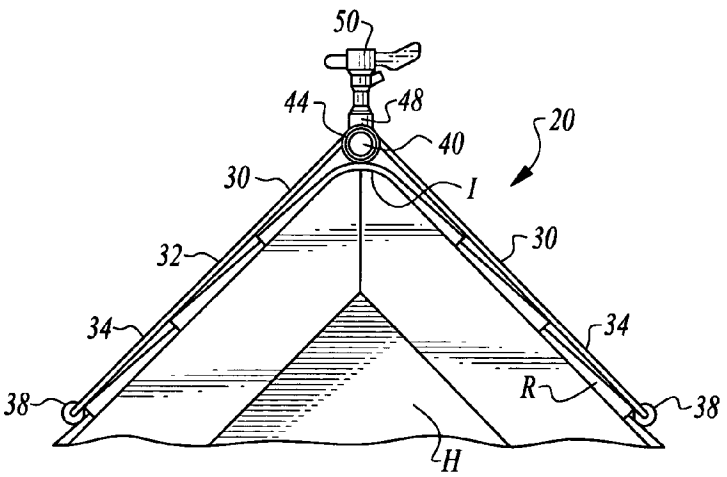
FIG. 4 is an end elevation view of that which is shown in FIG. 2.
Figure 2:
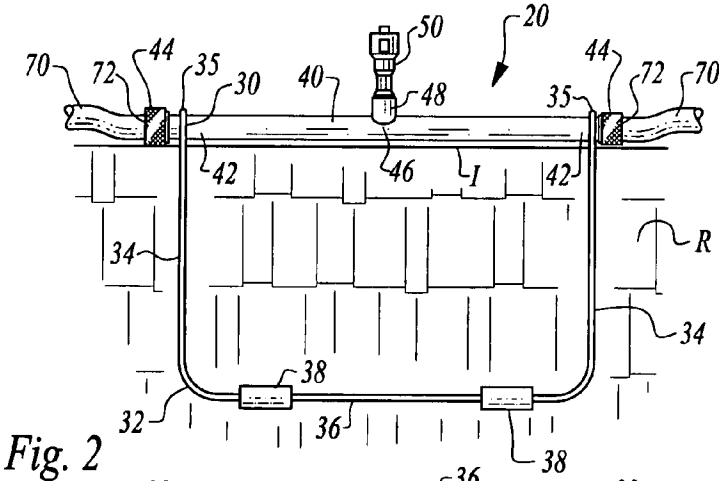
FIG. 2 is a front elevation view of one of the assemblies of the system including a base and a sprinkler thereon and with hoses coupled to the assembly, with the assembly shown mounted upon a roof of the structure.
Figure 3:
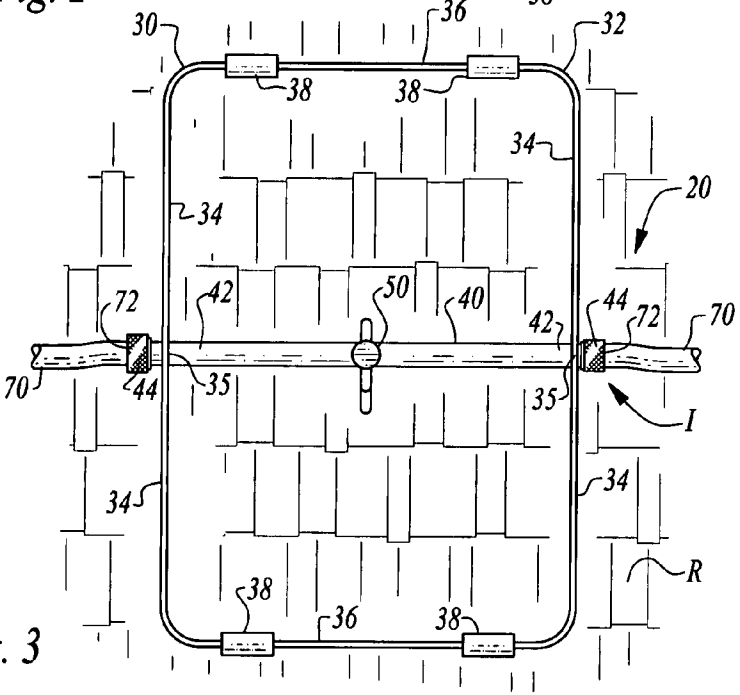
FIG. 3 is a top plan view of that which is shown in FIG. 2.

More specifically, and with particular reference to FIGS. 2-4, details of the roof support base 30 of each assembly 20 are described, according to a preferred embodiment. The base 30 is preferably formed as a loop 32 of elongate rigid material, such as aluminum tubing or solid aluminum bar stock or thin walled steel tubing or tubing of some other strong but lightweight material. Other such potential materials include composite materials and plastic materials. Most preferably, the material is one which can maintain strength in a high UV radiation environment, such as on a roof R of a house H. Furthermore, it is somewhat desirable that the base 30 have some weight associated therewith to place a center of mass of the entire assembly 20 fairly low and preferably below the ridge I of the roof R, for maximum stability of the assemblies 20 upon the roof R.

This loop 32 includes two pairs of diagonal segments 34 which extend at a diverging angle down to lower ends where they transition into horizontal segments 36 on either side of the ridge I. The horizontal segments 36 then transition to separate diagonal segments 34 of the second pair which extend back up to the ridge I of the roof R. Bends 35 in the loop 32 are provided adjacent the ridge I. The horizontal segments 36 preferably include feet 38 near each end thereof. The feet 38 help to avoid damage to the roof by being formed of a rubber hydrocarbon foam or other resilient material. Also, the feet support the entire assembly 20 if the angle between the diagonal segments is greater than that of the roof R, or if the assembly 20 is used on the flat ground, such as for a sprinkler support when not in use for fire suppression.

The base 30 also includes a center tube 40 extending parallel with and adjacent to the ridge I of the roof R. This center tube 40 is coupled to the loop 32 at each of the bends 35. These bends 35 are preferably adjacent ends 42 of the center tube 40.

The bends 35 are preferably adjustable so that the loop 32 can be caused to have a diverging angle between pairs of diagonal segments 34 which match that of the pitch of the roof. Such pitch matching allows the diagonal segments to be in contact with the roof at a variety of different positions along the segments 34, for load distribution and minimization of any potential damage to shingles or other structures on the roof R. As one example, the diverging angle could be 90° to match a roof pitch of 12 to 12 (a 50% slope).

Such adjustability of the diagonal segments 34 of the roof 30 at the bend 35 is most preferably provided by merely bending the loop 32, so that the bends 35 act as a bendable junction until an appropriate angle is provided between the pairs of diagonal segments 34. The loop 32 is preferably formed of materials and with a geometry which facilitates such bending, preferably by hand with a moderate amount of force applied. As another alternative, a tool could be provided or separately utilized for such bending.

As another alternative, the loop 32 could be interrupted by an adjustable fitting in each of the bends 35 which exhibit angle adjustability between the two diagonal segments 34. For instance, the diagonal segments 34 could at their upper ends include somewhat planar ears which overlap each other and which have a bolt and nut combination passing through the two ears. When the bolt and nut are loosened, the diagonal segments 34 of each pair would be pivotable relative to each other. When the bolt and nut combination are tightened, the diagonal segments 34 would exhibit a fixed angle therebetween. Other means to adjust an angle between the diagonal segments 34 could also be utilized to cause matching of the angle of divergence between the diagonal segments 34 at the bends 35 to match that of the roof R pitch.

While two pairs of diagonal segments 34 are shown in FIGS. 2-4, the base 30 could have only one pair of diagonal segments 34, so that no loop 32 would be provided, or more than two pairs of diagonal segments could be provided.

The center tube 40 is preferably an elongate hollow tubular structure which is rigid and linear in form. Each end 42 preferably includes a fitting 44 thereon suitable for removable attachment to a hose, such as a standard garden hose. Preferably, at least one of the fittings 44 is provided with a removable plug. Thus, the assembly 20 can be utilized with only one of the fittings 44 coupled to a garden hose, or with both of the fittings 44 coupled to a garden hose 70. These fittings 44 provide a preferred form of first and second hose 70 interfaces.

While a garden hose 70 is specified in a simplest form of this invention, more heavy duty versions of this invention could be provided where a larger diameter hose 70 or more heavy duty hose 70 might be utilized, even including a fire hose and fittings appropriate for computability with standard fire department fire hose. This center tube 40 preferably has a T-joint 46 at a midpoint thereof with a riser 48 extending up from the elongate main body of the center tube 40. This riser 48 has the sprinkler 50 mounted thereto.

The sprinkler 50 is preferably an impact sprinkler of a type which rotates continuously spreading water out of a water outlet in a circular pattern away from the sprinkler 50. One such suitable sprinkler 50 is similar to that described in U.S. Pat. No. 4,055,304, incorporated herein by reference. Other sprinklers could be provided, with the sprinklers most preferably providing 360° of coverage. In one form of the invention, the sprinkler 50 could be provided by a user and the system 10 would merely be provided with assemblies 20 that have risers 48 which are open and ready to receive sprinklers 50 to be selected by the user.

Figure 5:
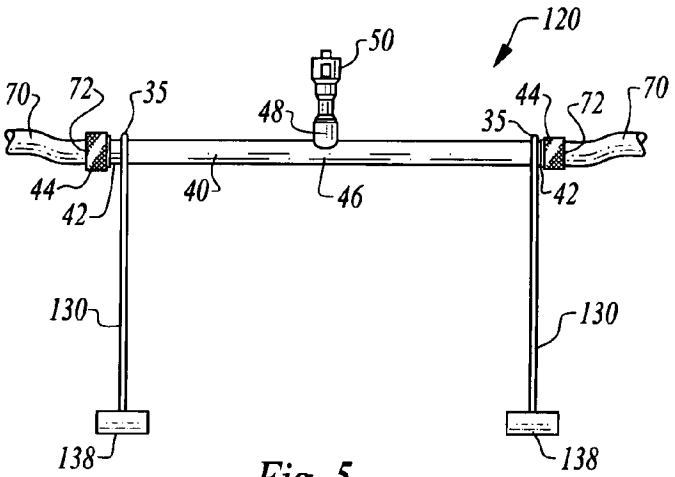
FIG. 5 is a front elevation view of an alternative embodiment of that which is shown in FIG. 2.

In an alternative embodiment, an alternative assembly 120 is disclosed (FIG. 5). With this alternative assembly 120, a base 130 is provided that includes diagonal segments that are not joined together by horizontal segments, but rather terminate at feet 138. Thus, two pairs of diagonal segments make up the entire alternative base 130 of the alternative assembly 120. As an alternative, one pair or more than two pairs might be provided. Other portions of the alternative assembly 120 including the center tube 40 and sprinkler 50 are similar to those described above.

With particular reference to FIGS. 1 and 6, other details of the overall system 10 are described, according to a preferred embodiment. Most preferably, the system 10 is provided to work with a variety of different water supplies. For instance, the system 10 could merely be provided with one or more assemblies 20 in a package, compatible with garden hoses 70 or other hoses available separately, and compatible with sprinklers 50 of a user's selection, or with the sprinklers 50 already mounted to the assemblies 20. Alternatively, the system 10 could be provided with multiple assemblies 20 and/or hoses 70 together as a kit.

To couple to the water supply, at least one of the hoses 70 extends down from the ridge I of the roof R to ground level. In a simplest form of the invention this hose 70 has an end 72 coupled to one of the assemblies 20 with the other end coupled to a hose bib B (FIGS. 1 and 6). The user need merely turn on a valve of the hose bib B and the system 10 commences operation. Specifically, water W flows through the hose 70, up to the roof R (along arrow C of FIGS. 1 and 6), to the first assembly 20 and out of the sprinkler 50 (along arrow A of FIG. 6). The water W can continue out of the center tube 40 if a second assembly 20 is attached. The water W passes through a second hose 70 (along arrow C) to the second assembly 20 and possibly other serially attached assemblies, to distribute water W (along arrow A) preferably over the entire house H.

If desired, a fire retardant tank 80 can be provided along the hose 70 between the hose bib B and the first assembly 20 of the system 10. The fire retardant tank 80 would preferably be a container with a fire retardant material therein, either solid or liquid, which is a water borne fire retardant. When water from the hose bib B enters the fire retardant tank 80, it reacts with the fire retardant within the tank and causes the water borne mixture of water and fire retardant to pass through the hose 70 to the assemblies 20. This fire retardant material would preferably be compatible with the sprinklers 50 so that the sprinklers 50 can adequately disperse the water and fire retardant over the roof R and surrounding structures including decks D and trees T and shrubs S surrounding the house H or other structure. In one form of the invention, the fire retardant within the tank 80 is of a type which forms a foam when coming into contact with water so that a foam material is dispersed by the sprinklers 50.

Often water pressure in a hose bib B is not reliable during a wildfire. If the water is municipally provided, it may be diverted to fire hydrants for fighting of the wildfire. If water provided through a domestic well, fire related power loss may cause loss of pressure. A beneficial attribute of the system 10 in at least one form is the provision of a backup water supply to feed the system 10. In particular, a pump 60 is provided coupled to a reservoir P and feeding the hoses 70 to deliver water W to the assemblies 20 of the system 10. This reservoir P could be a pond, a creek, a swimming pool, or some other reservoir of water. The pump 60 could operate on electricity with an appropriate set of batteries 62 and a power system 64 to charge the batteries 62 when power is available. Then if power is out, the batteries 62 provide power to the pump 60 to supply water to the system 10. As another alternative, an engine 66 could be provided along with a fuel tank 68 so that the engine 66 can be started and burn fuel 68 to generate power to drive the pump 60.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A system for deployment on a roof of a structure to protect the structure from fire, the system comprising in combination:

at least one sprinkler;

a hose interface coupled to said sprinkler;

a roof support base coupled to said sprinkler and adapted to support the sprinkler upon a roof of a structure, straddling a ridge of the roof;

said base including at least two elongate rigid diagonal segments diverging from each other at an angle less than 180°;

at least one hose extending from a water supply to said hose interface;

wherein said base includes a center tube, said center tube oriented substantially perpendicular to said diagonal segments, said center tube adapted to be oriented substantially parallel with the ridge of the roof and adjacent the ridge of the roof;

wherein said diagonal segments are provided in pairs coupled to said center tube near ends of said center tube with two of said diagonal segments in a first pair located adjacent a first end of said center tube and two of said diagonal segments in a second pair located adjacent a second end of said center tube, said sprinkler coupled to said center tube at a point on said center tube between said ends;

wherein said diagonal segments within each said pair are joined together adjacent said center tube, said diagonal segments joined together through a bendable junction, such that said diagonal segments can be bent to a diverging angle matching a pitch of the roof;

said diagonal segments formed of a material and with geometry which allows said diagonal segments to be bent by hand applied forces to a new angle matching a pitch of the roof and remain at said new angle after being bent;

wherein two horizontal segments extend between lower ends of said diagonal segments with one of said horizontal segments adapted to be located on a first side of the ridge and a second one of said horizontal segments adapted to be located on a second side of the ridge;

wherein said diagonal segments and said horizontal segments together form a full circuit, said circuit formed of a single piece of said material;

said new angle of said diagonal segments allowing said center tube to be located adjacent the ridge of the roof when said diagonal segments are positioned straddling the ridge of the roof; and said horizontal segments each including at least one foot having a width greater than a width of said horizontal segments, each said foot formed of a resilient material adapted to contact the roof and minimize damage to the roof while inhibiting slippage of said horizontal segments relative to the roof.

2. The system of claim 1 wherein said system further includes a second hose interface coupled to said sprinkler, and a second hose extending from said second hose interface to a second sprinkler, such that water from said water supply supplies water to both said at least one sprinkler and said second sprinkler, said second sprinkler spaced from said at least one sprinkler.

3. The system of claim 1 wherein said diagonal segments and said horizontal segments together form a full loop.

4. The system of claim 1 wherein each of said diagonal segments extends from said center tube to a tip, said tip including a foot thereon adapted to abut the roof.

5. The system of claim 1 wherein a fire retardant supply is interposed between said at least one hose and the water supply, such that water from the water supply passes through a fire retardant supply and picks up a fire retardant of a water borne variety for delivery through said hose to said at least one sprinkler for distribution from said at least one sprinkler.

6. A sprinkler and base assembly for resting of the sprinkler adjacent a ridge of a roof, such as for fire suppression, comprising in combination:

a water outlet sprinkler;

a center tube having said sprinkler mounted thereon and having ends with a hose interface on one of said ends;

a roof support base coupled to said center tube;

said base including at least two elongate rigid diagonal segments diverging from each other at an angle less than 180°;

wherein said base includes a center tube, said center tube oriented substantially perpendicular to said diagonal segments, said center tube adapted to be oriented substantially parallel with the ridge of the roof and adjacent the ridge of the roof;

wherein said diagonal segments are provided in pairs coupled to said center tube near ends of said center tube with two of said diagonal segments in a first pair located adjacent a first end of said center tube and two of said diagonal segments in a second pair located adjacent a second end of said center tube, said sprinkler coupled to said center tube at a point on said center tube between said ends;

wherein said diagonal segments within each said pair are joined together adjacent said center tube, said diagonal segments joined together through a bendable junction, such that said diagonal segments can be bent to a diverging angle matching a pitch of the roof;

said diagonal segments formed of a material and with geometry which allows said diagonal segments to be bent by hand applied forces to a new angle matching a pitch of the roof and remain at said new angle after being bent;

wherein two horizontal segments extend between lower ends of said diagonal segments with one of said horizontal segments adapted to be located on a first side of the ridge and a second one of said horizontal segments adapted to be located on a second side of the ridge;

wherein said diagonal segments and said horizontal segments together form a full circuit, said circuit formed of a single piece of said material;

said new angle of said diagonal segments allowing said center tube to be located adjacent the ridge of the roof when said diagonal segments are positioned straddling the ridge of the roof; and said horizontal segments each including at least one foot having a width greater than a width of said horizontal segments, each said foot formed of a resilient material adapted to contact the roof and minimize damage to the roof while inhibiting slippage of said horizontal segments relative to the roof.

7. The assembly of claim 6 wherein said hose interface of said center tube includes at least one threaded hose fitting thereon adapted to be coupled to a hose.

8. The assembly of claim 7 wherein said center tube includes a threaded hose fitting at each end of said center tube, such that similar assemblies can be serially coupled together with hoses therebetween.

9. The assembly of claim 8 wherein said base is coupled to said center tube adjacent at least one end thereof.

10. The assembly of claim 9 wherein said base forms a complete loop coupled to said center tube adjacent each of said ends and extending lateral to said center tube spaced from each side of said center tube, said loop including two pairs of said diagonal segments each coupled to opposite ends of said center tube, and horizontal segments joining together lower ends of said diagonal segments.

11. The assembly of claim 9 wherein said base includes at least four separate elongate rigid diagonal segments extending laterally and downwardly from said center tube in pairs opposite each other, the pairs diverging from each other at an angle less than 180°.

12. A method for protecting a structure from wildfire outside of the structure, the method including the steps of:

providing at least one sprinkler and base assembly for resting of the sprinkler adjacent a ridge of a roof of the structure, the assembly including a water outlet sprinkler on an elongate center tube, a hose interface coupled to the sprinkler through the center tube, a roof support base coupled to the sprinkler through the center tube and adapted to support the sprinkler upon the roof of the structure, straddling the ridge of the roof and the base including at least two elongate rigid diagonal segments diverting from each other at an angle less than 180°, the diagonal segments provided in pairs coupled to the center tube near ends of the center tube with two of the diagonal segments in a first pair located adjacent a first end of the center tube and two of the diagonal segments in a second pair located adjacent the second end of the center tube, the sprinkler coupled to the center tube at a point on the center tube between the ends, the diagonal segments within each pair of diagonal segments joined together adjacent the center tube through a bendable junction such that the diagonal segments can be bent to a diverging angle matching a pitch of the roof, the diagonal segments formed of a material and with geometry which allows the diagonal segments to be bent by hand applied forces to a new angle matching a pitch of the roof and remain at the new angle after being bent, the assembly including two horizontal segments extending between lower ends of each diagonal segment with one of the horizontal segments adapted to be located on a first side of the ridge of the roof and a second one of the horizontal segments adapted to be located on a second side of the ridge, such that together the diagonal segments and the horizontal segments form a full circuit, said circuit formed of a single piece of the material, the new angle of the diagonal segments allowing the center tube to be located adjacent the ridge of the roof when the diagonal segments are positioned straddling the ridge of the roof, and the horizontal segments each including at least one foot having a width greater than a width of the horizontal segments, each foot formed of a resilient material adapted to contact the roof and minimize damage to the roof while inhibiting slippage of the horizontal segments relative to the roof;

putting the assembly on the roof straddling the ridge of the roof;

coupling a hose to a water supply and to the hose interface of the center tube;

routing water from the water supply through the hose to the sprinkler for distribution of an at least partially water liquid onto the roof;

adjusting the angle of divergence of the diagonal segments to match a pitch of the roof of the structure at a ridge of the roof; and positioning the assembly with the center tube adjacent the ridge of the roof.

* * * * *